US006171744B1

(12) United States Patent
Nakazawa et al.

(10) Patent No.: US 6,171,744 B1
(45) Date of Patent: Jan. 9, 2001

(54) TONER FOR ELECTROPHOTOGRAPHY, METHOD FOR PRODUCING IT, AND METHOD OF IMAGE FORMATION

(75) Inventors: Hiroshi Nakazawa; Jun Igarashi, both of Minamiashigara (JP)

(73) Assignee: Fuji Xerox Co., Ltd., Tokyo (JP)

( * ) Notice: Under 35 U.S.C. 154(b), the term of this patent shall be extended for 0 days.

(21) Appl. No.: 09/514,634

(22) Filed: Feb. 29, 2000

(30) Foreign Application Priority Data

Mar. 26, 1999 (JP) ..... 11-083130

(51) Int. Cl.[7] ..... G03G 9/097; G03G 13/22

(52) U.S. Cl. ..... 430/110; 430/111; 430/126; 430/137

(58) Field of Search ..... 430/110, 111, 430/126, 137

(56) References Cited

U.S. PATENT DOCUMENTS

| | | | | |
|---|---|---|---|---|
| 5,370,962 | * | 12/1994 | Anderson et al. | 430/137 |
| 5,510,220 | * | 4/1996 | Nash et al. | 430/110 |
| 5,674,655 | * | 10/1997 | Guistina et al. | 430/110 |

FOREIGN PATENT DOCUMENTS

| | | |
|---|---|---|
| 2-77756 | 2/1990 | (JP) . |
| 4-186370 | 7/1992 | (JP) . |
| 4-257868 | 9/1992 | (JP) . |
| 8-278658 | 10/1996 | (JP) . |
| 10-268563 | 10/1998 | (JP) . |

* cited by examiner

*Primary Examiner*—Roland Martin
(74) *Attorney, Agent, or Firm*—Oliff & Berridge, PLC

(57) ABSTRACT

Provided are a toner for electrophotography, a method for producing it, and a method of image formation with it. The toner fuses little in the apparatus where it is produced, and its productivity is high. The toner has good characteristics including charging characteristics and coloring characteristics, and the amount of coarse grains in the toner is small. The method for producing the toner includes a step of kneading at least a toner-forming material to prepare a kneaded mixture, a step of grinding and classifying at least the kneaded mixture to prepare toner grains, and a step of mixing at least an external additive in the toner grains. In the method, an inorganic oxide containing the same metal element at least for its core is added to the system in all of the kneading step, the grinding and classifying step and the external additive-mixing step.

17 Claims, 2 Drawing Sheets

Figure 1:
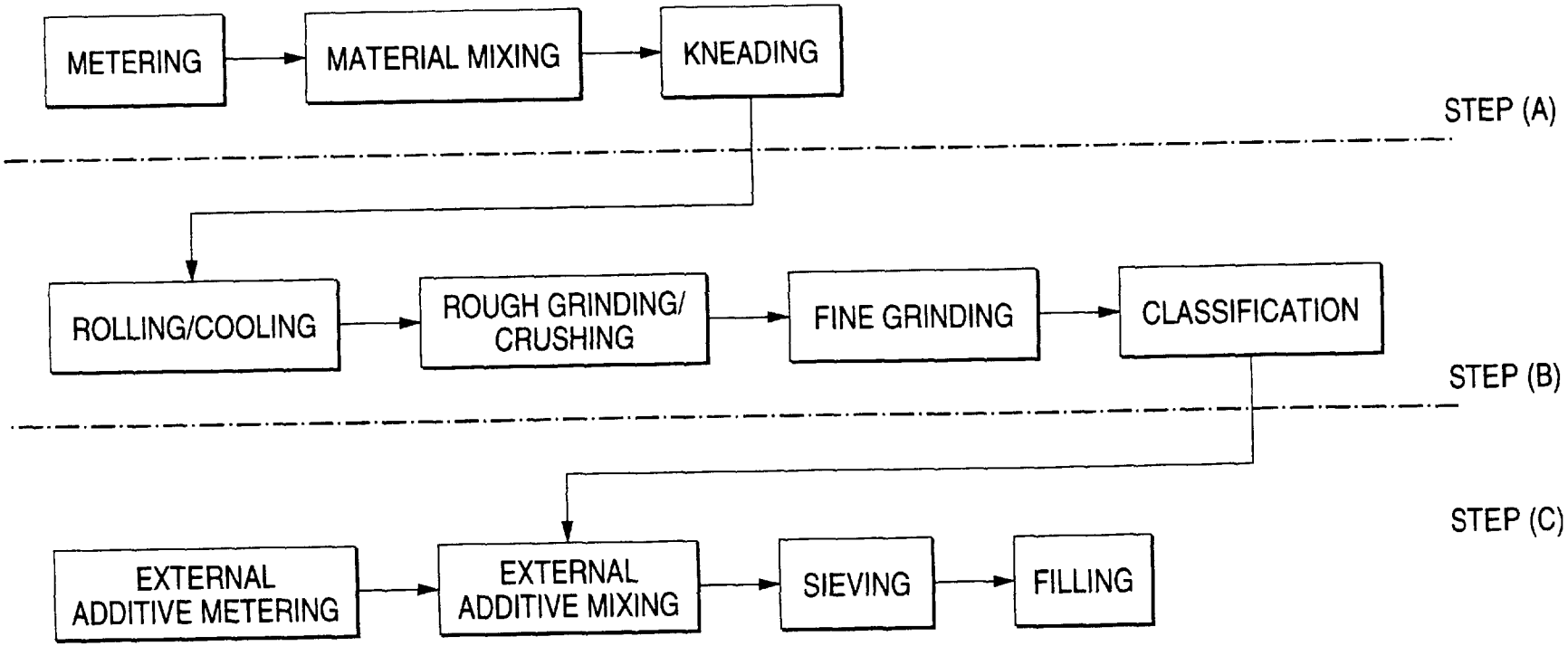

TONER FOR ELECTROPHOTOGRAPHY, METHOD FOR PRODUCING IT, AND METHOD OF IMAGE FORMATION

BACKGROUND OF THE INVENTION

1. Field of the Invention

The present invention relates to a toner for electrophotography, electrostatic recording, electrostatic printing, etc., a method for producing it, and a method of image formation with it.

2. Description of the Related Art

Toner for electrophotograpy (this will be hereinafter referred to simply as "toner") could be obtained by mixing, melting and kneading a binder resin, a colorant, and optionally a lubricant, an antistatic agent and other additives, cooling and solidifying the resulting mixture, grinding the solid, classifying the ground powder to prepare a toner matrix, followed by adding external additives such as a fluidizing agent, an antistatic agent, a cleaning promoter and the like to the toner matrix to thereby make them adhere to and fix on the surfaces of the toner matrix particles, and finally sieving the thus-processed toner particles to thereby remove coarse particles having been grown too large in the step of adding thereto the external additives.

In electrophotography with toner for image formation, the electrostatic latent image formed on a latent image carrier is developed with toner, then the toner image is once transferred onto an intermediate image receptor, and thereafter re-transferred onto an image-receiving object such as plain paper, plastic film or the like, and finally the toner image on the image-receiving object is fixed thereon under heat and/or pressure in a fixation unit generally equipped with a thermal fixing roll or belt system.

Therefore, the toner particles to be used in image formation through electrophotography have the capability of plastic deformation by heat and/or pressure. With the recent needs for power-saving and instant-on duplicators for rapid duplication, toner capable of melting at lower temperatures than usual is desired. However, toner that satisfies the requirement is often problematic in that it will fuse in the apparatus where it is produced.

Realizing high-quality images is especially desired these days, for which fine toner particles having a reduced particle size and having a narrowed particle size distribution are necessary. However, such fine toner particles will fuse more easily in the apparatus where they are produced. This is because re-structuring the apparatus for producing the intended fine toner particles will inevitably bring about the result that the particles produced therein fuse more easily. Concretely, for example, in the step of classifying toner particles, centrifugal classifiers heretofore used will have to be so modified that they enable high-revolution classification with an increased air flow. For their capabilities, however, the modified units for such high-revolution classification with an increased air flow being introduced thereinto are limited in producing the intended fine toner particles having a reduced particle size and having a narrowed particle size distribution, and will augment the fusion of the toner particles around rotors, etc.

In place of centrifugal classifiers, inertial classifiers where particles are classified by their inertial force are available on the market these days and are being used widely in the art. In the inertial classifier, particles having a large particle size are blown far away by their inertial force, while the others having a small particle size flow along a curved block, a Coanda block, owing to the specific capabilities of the classifier. Increasing the number of the edges for classification in the inertial classifier of that type enables multi-division classification. Even for small-sized particles, the inertial classifier could well classify them merely by moving the position of the edges without sacrificing its classification efficiency. Using the inertial classifier has made is possible to produce even fine toner having a reduced particle size and having a narrowed grain size distribution. In addition, only one inertial classifier enables multi-stage classification, for which, however, one centrifugal classifier must be repeatedly driven plural times. Having the advantages of reduced equipment cost and space with no reduction in the classification efficiency even for small-sized particles, inertial classifiers are being much used these days in the art.

However, inertial classifiers are still confronted with some problems. Concretely, in an inertial classifier, many toner particles fuse around the edges that define the classification point and around the ejector, and the fused toner particles will change the classification point. In that case, it becomes difficult to stably produce toner particles having the same quality (that is, having the same particle size distribution). Depending on the degree of toner fusion, the production condition must be re-settled, or the fused toner particles must be removed. This increases the cost for apparatus inspection, and greatly lowers the apparatus performance, as the apparatus must be dissembled and cleaned.

Also in the step of grinding toner raw material, the apparatus to be used must be modified so as to increase its grinding efficiency for the recent fine toner particles having a reduced particle size and having a narrowed particle size distribution. Concretely, in a jet-mill grinder, the air flow rate is increased; and for other mechanical grinders, the rotor revolution is increased. In particular, for grinding into fine toner particles having a narrowed particle size distribution, used is a grinding system equipped with a built-in pre-classifier for removing coarse particles or with an external closed circuit. In the grinding system of that type, however, toner particles fuse around the rotor in the built-in pre-classifier, and the fused particles will vary the classification point in the pre-classifiers. This is problematic as the toner particles ground could not have the intended particle size.

For increasing the grinding efficiency in producing fine toner particles having a reduced particle size, a method of varying the constituent monomers for the binder resin to be in toner, or a method of lowering the softening point or the glass transition point of the binder resin may be employed. These methods are effective for improving the grindability of toner particles, but are still problematic in that many toner particles fuse inside the grinder and the classifier used and even in the pipe line that connects the units, and the fused particles will soon come to have negative influences on the production condition within a short period of time. Moreover, it is known that the toner produced in the process where many particles fuse inside the production units contains an increased amount of coarse particles (having a large particle size of from 16 to 45 $\mu$m or so). The coarse toner particles will form image defects of grids and white spots on duplications. In addition, they will have not a few negative influences on the charging characteristics and the fixing characteristics of toner. Even though fine toner particles could get improved grindability in some degree according to the methods as above, they will much sacrifice their intrinsic properties for it.

Another method that may be employable for the intended purpose will be to add to toner a material capable of improving the grindability of toner material. For example, in Japanese Patent Laid-Open No. H04-257868, proposed is a technique of using an aromatic petroleum resin for improving both the grindability and the fixing capability of toner; and in Japanese Patent Laid-Open No. H07-278658, proposed is a technique of using a hydrogenated petroleum resin for improving both the grindability and the thermal stability of toner. The techniques proposed could improve the grindability of toner, but are still problematic in that they worsen the charging capability of toner.

For producing the intended, fine toner particles that can melt even at low temperatures and have a reduced particle size and a narrowed particle size distribution, the problem to be solved is that particles fuse inside the production equipment and many coarse particles are formed therein. To solve the problem, another method has been tried. This is to coat the inner surface of the body unit of an apparatus for toner production as well as that of the pipe line around the apparatus and that of the peripheral units such as cyclones with a carbon-dispersed fluororesin. However, in the apparatus and through the pipe line around it and even in cyclones, toner particles all the time colloid/rub against their walls along with air streams running therethrough at a high speed of from 15 to 100 m/sec and even at a higher speed of from 100 to 200 m/sec. In that condition, even though the inner walls of the apparatus body and its peripheral lines and units are coated with such a fluororesin, the resin coating will be immediately peeled off as the resin is not tough and has poor abrasion resistance. Therefore, the resin coating could not be put into practical use. What is more, since the fluororesin is an insulating material, using it in toner production equipment is not practicable from the viewpoint of preventing accidental explosions.

For effectively overcoming the problem of toner fusion in production equipment, at present, no one knows a method of modifying the equipment for toner production, modifying the materials for the units of the equipment or modifying the toner materials.

With the recent tendency in the art toward full-color, high-quality duplications, it is desired that colorant could be dispersed in toner in the form of primary grains as much as possible, and hardly-dispersible, fine-grain colorants having a reduced grain size and having an increased surface area are being used in toner. At present, however, such fine colorant grains could not be dispersed in toner in the form of primary grains, even when a high-shear blender capable of realizing relatively high-degree dispersion is used for blending them. If colorant grains are poorly or locally dispersed in the binder resin in toner, or even though they are uniformly dispersed therein but it the colorant dispersion units are large, the toner containing them will be ground in the next grinding step after the step of melt-kneading the colorant grains in toner, while the colorant grains still exist locally in the toner or while the toner still contains large dispersion units of colorants. If so, the compositional constitution of the toner produced will be uneven. In particular, when the colorants are dispersed extremely poorly in the binder resin, the toner produced will partly contain segments of a single component only or particles having an uneven compositional constitution. As a result, the charge spectrum of the toner will be broadened, and, as the case may be, the toner will be charged in reversed polarity. Moreover, since the toner material is ground into fine particles while the colorant grains are exposed outside the toner particles or while they are released from the toner particles, the powdery fluidity of the resulting toner particles will be greatly lowered, or, as the case may be, the exposed or released colorant grains will cause filming on photosensitive materials.

For example, for full-color colorants, if they are poorly dispersed in toner, their transparency will be lowered, and the underlying colorant could not exhibit its color. As a result, the images formed could not exhibit the intended color. For monochromatic colorants, their color reproduction range will be narrowed, their saturation will be lowered, their coloring capability fill be lowered, the density of the images formed will be lowered, and the granularity of toner containing them will be lowered. Moreover, the charging difference between colors of yellow, magenta and cyan will increase, and the binder strength will be lowered. As a result, the poorly dispersed colorant grains will have some negative influences on the fixing capability of toner containing them, and, still another problem with them is that the grain size distribution in the toner particles having been ground in the grinding step is broadened. What is more, since the charge spectrum of toner is broadened, the background in duplications is often fogged, and the apparatus used will be readily soiled with toner whereby its running life will be shortened.

On the other hand, for particles for two-component black toner, the toner could not be charged to a satisfactory degree. In addition, the charge spectrum of the toner will be extremely broad, and the toner could not be admixed to a desired degree. As a result, the images formed will be fogged, and the apparatus used will be soiled.

For magnetic colorant powders, they will aggregate to give local segments of powder aggregates, and will case various troubles. For example, the segments will release free magnetic powders from them, and the free magnetic powders will scratch the surface of photoreceptors in duplicators, or will deposit thereon while being carried by the developer carrier. As a result, the density of the color images formed will be become gradually uneven. In order that these colorant materials are dispersed in toner in the form of primary grains as much as possible, for example, they may be previously flashed before use, or they are first formed into a master batch before being mixed in toner. As the case may be, a dispersant may be added to toner along with the colorant materials. However, even though such a dispersion promoter is used, it is not still effective for making the colorant materials well dispersed in toner in the form of primary grains. The method of flashing the colorant materials, and the method of preparing a master batch of colorants followed by mixing it in toner in plural stages are both problematic in that they increase the raw material costs and the production costs.

Various dispersion promoters have heretofore been proposed, but all of them are not satisfactory as they have some negative influences on the charge spectrum of toner or as they often detract from the coloring characteristics of toner for full-color duplications. For example, Japanese Patent Laid-Open No. H04-186370 discloses a phthalocyanine derivative that serves as a dispersion promoter. When the derivative is added to toner, the colorants could be effectively dispersed in toner in some degree, but their coloring capabilities are lowered. What is more, the color reproduction range of the colorants is narrowed, and the saturation thereof is lowered. When the derivative is added to two-component toner that contains carbon black, or to one-component toner that contains magnetic powder, it noticeably broadens the charge spectrum of the toner. As a result, the background in duplications is much fogged, and the apparatus used is much soiled.

At present, no one could obtain easily-meltable, fine-particle toner having a reduced particle size and having a narrowed particle size distribution, of which the advantages are that colorants can be uniformly dispersed therein to a great extent, that the toner particles do not fuse in the equipment where they are produced, and that the amount of coarse particles having a large grain size in the toner is small. Under the current situation, it is still difficult to produce fine toner particles having a reduced particle size in an efficient manner not having any negative influences on the toner characteristics, especially on the charging characteristics and the coloring characteristics of the toner produced.

SUMMARY OF THE INVENTION

Solving the problems as above in the related art, the present invention provides a toner for electrophotography and a method for producing it. Being free from the problems, the toner of the invention is advantageous in that it does not fuse in the equipment where it is produced, thereby preventing the reduction in its productivity, that it has good toner characteristics including charging characteristics and coloring characteristics, that the amount of coarse particles having a large particle size in the toner is small, and that the productivity of the toner is high. The invention also provides a method of image formation with the toner, which is advantageous in that the toner used is deteriorated little while being charged and therefore gives good images with no fog.

Specifically, the invention provides a toner for electrophotography comprising a toner particles containing a colorant and a binder resin, wherein the toner particles containing an inner inorganic oxide in the inside, and the toner particles containing an outer inorganic oxide on the surface, in which the inner inorganic oxide containing a at least same metal element of the outer inorganic oxide, and the amount of particles having a size of not smaller than 20 $\mu$m is at most 100 ppm.

The invention also provides an image forming method comprising a step of developing an electrostatic latent image formed on an electrostatic latent image carrier with a toner to form a toner image, a step of transferring the toner image onto an image-receiving object to form a transferred image thereon, and a step of fixing the transferred image on the object, wherein the toner for described above is used.

This invention also provides a method for producing a toner for electrophotography comprising a step of kneading at least a toner-forming material to prepare a kneaded mixture, a step of grinding and classifying at least the kneaded mixture to prepare toner particles, and a step of mixing an external additive in the toner particles, wherein the toner-forming material contains a first inorganic oxide, wherein the grinding and the classifying step containing an adding a second inorganic oxide, and the external additive containing a third inorganic oxide, in which the first inorganic oxide, the second inorganic oxide and the third inorganic oxide having the same metal element at least for its core.

The inorganic oxide may has a mean primary grain size of 5 to 50 nm.

The inorganic oxide may be a titanium compound as prepared by processing a part or all of $TiO(OH)_2$ produced in a wet process, with a silane compound.

The inorganic oxide may be added to the system in the grinding and classifying step just before the ground grains are classified in a classifier.

The inorganic oxide may be added to the system in the grinding and classifying step directly into a grinder through an injection unit inserted thereinto or via a feed port of the grinder.

BRIEF DRAWINGS OF THE INVENTION

Figure 2:
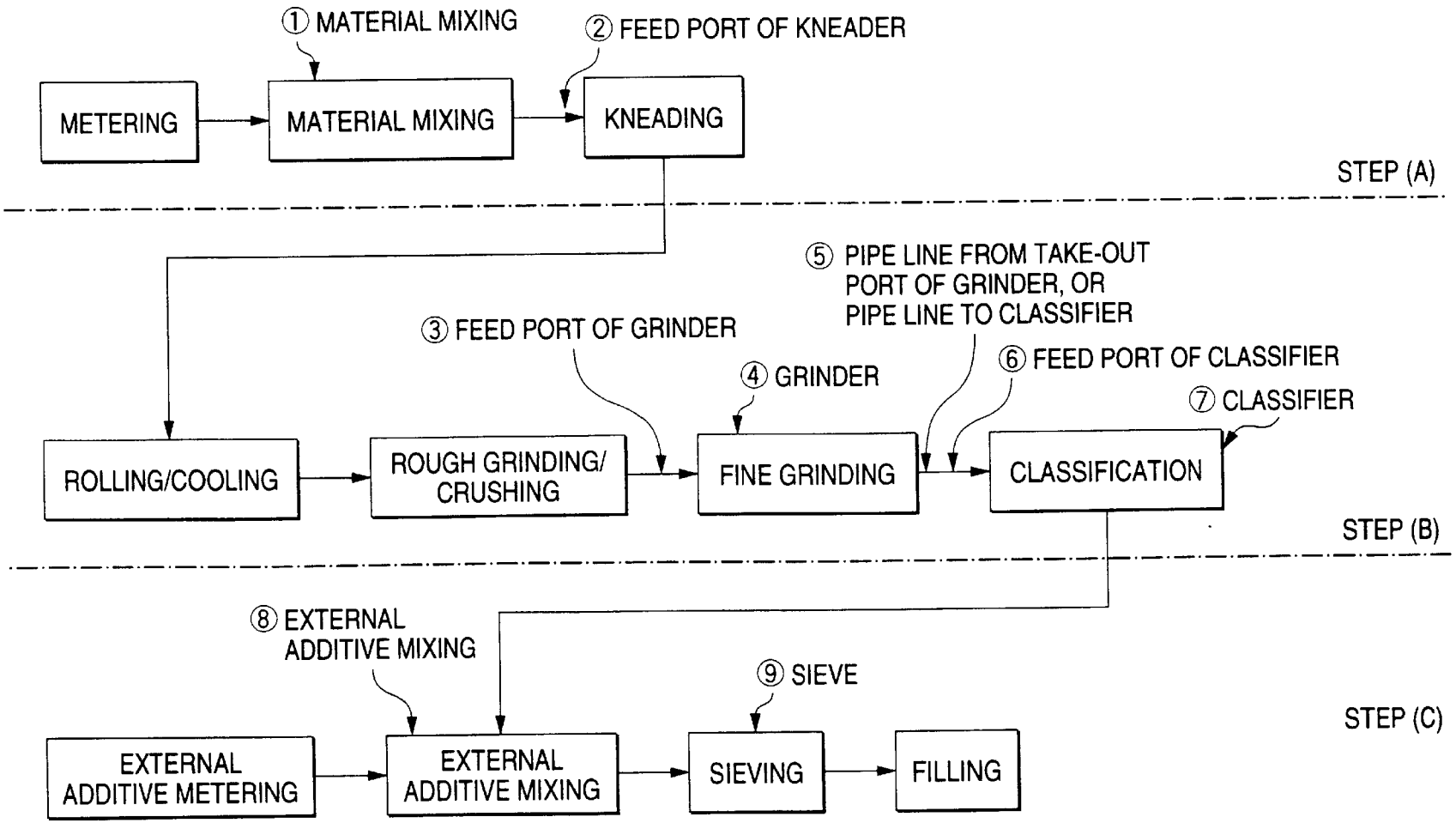

Preferred embodiments of the invention will be described in detail based on the following figures, wherein:

FIG. 1 is a flow chart showing one embodiment of the method for producing the toner of the invention; and FIG. 2 is a flow chart showing the process in Examples for producing the toner of the invention.

DESCRIPTION OF THE PREFERRED EMBODIMENTS

The method for producing a toner for electrophotography of the invention is described in detail hereinunder.

Method for Producing Toner for Electrophotography:

The method for producing a toner of the invention includes a step of kneading at least a toner-forming material to prepare a kneaded mixture (this will be hereinafter referred to as "step (A)"), a step of grinding and classifying at least the kneaded mixture to prepare toner particles (this will be hereinafter referred to as "step (B)"), and a step of mixing at least an external additive in the toner particles (this will be hereinafter referred to as "step (C)"), wherein an inorganic oxide containing the same metal element at least for its core is added to the system in all of the kneading step, the grinding and classifying step, and the external additive-mixing step.

The steps (A) to (C) are described in detail with reference to the figures.

FIG. 1 is a flow chart showing one embodiment of the method for producing a toner of the invention, which, however, is not whatsoever intended to restrict the scope of the invention.

In the step (A), a toner-forming material that includes a binder resin, a colorant and others, which will be described hereinunder, is metered with a metering unit, and mixed in a raw material-mixing unit. The resulting mixture is fed into a kneader via a metering feeder, and kneaded therein under heat and/or high shear to prepare a kneaded mixture.

In the step (B), the resulting kneaded mixture is rolled, cooled, a roughly crushed a finely ground into fine particles having a volume-average diameter of from 4 to 12 $\mu$m or so. Next, the particles are classified in a classifier to separate finer particles that are smaller than the intended ones and optionally coarse particles larger than the intended ones, thereby obtaining toner particles having an intended particle size distribution.

In the step (C), various external additives typically including an inorganic oxide are added to and mixed in the resulting toner particles for the purpose of making the particles fluid and making them have a charging capability and optionally a cleaning capability, and thereafter the particles are optionally sieved and filled to obtain the intended toner.

In the method for producing a toner of the invention, an inorganic oxide containing the same metal element at least for its core is added to the system in all of the step (A), the step (B) and the step (C). In this, the amount of the inorganic oxide to be added in each step is not specifically defined, and may be determined in any desired manner depending on the object of the additive, inorganic oxide. The additive may be added to at least one site in each step, but may be added to 2 or more sites in each step.

(A) Kneading Step:

Where the first inorganic oxide added in the step (A) is of the same sort as that of the third inorganic oxide added in the external additive-mixing step (C), the additive, inorganic oxide could improve the dispersibility of the colorant without having any influence at all on the charging capability of the toner produced. (The same sort as referred to herein for the inorganic oxide is meant to indicate that the inorganic oxide contains the same metal element at least for its core.) Though not clear, the reason why the inorganic oxide added does not have any negative influence on the charging capability of the toner will be because the toner particles being ground will be broken at the interface between the binder resin and the inorganic oxide and therefore the proportion of the inorganic oxide exposed out on the surfaces of the toner particles will increase. Adding the first inorganic oxide in the step (A) is effective for preventing the kneaded mixture from fusing in the apparatus where the mixture is being prepared, and improves the powdery fluidity of the mixture. Therefore, adding it in the step (A) facilitates discharging the powdery mixture from the raw material mixing unit and is effective for preventing the feeding and kneading unit in the kneading step from being necked in (that is, for preventing the unit from being clogged).

With the recent tendency in the art toward fine toner particles having a reduced particle size and a narrowed particle size distribution, the finer particles and the coarse particles having been separated in the grinding and classifying step are recycled and fed back to the kneading step (A). In that case, adding the first inorganic oxide in the step (A) is more effective. Accordingly, adding the inorganic oxide of the same sort both in the step (A) and in the step (C) is effective for improving the dispersibility of the colorant and enhancing the charging capability of the toner to be produced, and also for preventing the kneaded mixture from fusing in the apparatus. As a result, the powdery mixture from fusing in the step (A) can be readily discharged out of the kneading unit and, in addition, the kneading power of the unit can be enhanced. Even when any of the ground fine particles, the classified finer particles and the classified coarse particles are added to the system in the step (A), it is still possible to continue the kneading operation without sacrificing the kneading capability of the unit, and the production costs could be reduced. What is more, the uppermost limit of the amount of the finer particles and the coarse particles that may be added to the system in the step (A) can be increased, and therefore the amount of the finer particles and the coarse particles to be discarded in the process can be reduced. This is favorable for environmental protection.

Regarding the site at which the inorganic oxide is added to the system in the step (A), for example, the additive may be metered like the other toner components, and may be mixed in the metered toner components. Alternatively, the additive, while being metered through a metering feeder disposed before the kneader, may be fed to the system along with the other toner components being fed thereto through a metering feeder also disposed before the kneader. The site for the additive addition is not limited to only one, but the additive may be added to the system in plural sites.

Regarding the mode of adding the inorganic oxide to the system in the step (A), the inorganic oxide of the same sort as that of the additive to be added in the external additive-mixing step (C) may be directly added to the system; or it may be added thereto after mixed with any other materials; or it may be added thereto after mixed with any of the ground fine particles (not collected in the cyclone in the step (B)), the classified finer particles and the classified coarse particles all having been separated in the grinding and classifying step (B).

In particular, it is desirable that the inorganic oxide (this is for improving the dispersibility of colorants in toner) is mixed with any of the ground fine particles, the classified finer particles and the classified coarse particles before it is added to the system in the step (A), as the dispersibility of the inorganic oxide itself in the system is improved. In this case, even when a large amount of the inorganic oxide is added, it does not detract from the color characteristics of the toner to be produced. In addition, the powdery fluidity of the kneaded mixture is increased, and the kneaded mixture can be readily discharged from the kneader. What is more, the kneader is prevented from being necked in (that is, it is prevented from being clogged), and the production costs can be reduced.

The amount of the inorganic oxide to be added to the system in the step (A) is between 0.05 and 5.0 parts by weight, more preferably between 0.1 and 2.0 parts by weight, relative to 100 parts by weight of the toner-forming material not including the inorganic oxide. If the amount is larger than 5.0 parts by weight, the colorant dispersibility could be improved to a higher degree but the transparency of full-color images formed with the toner will be lowered. On the other hand, if the amount is smaller than 0.05 parts by weight, the additive could not exhibit its capability to improve the colorant dispersibility.

(B) Grinding and Classifying Step:

Adding the second inorganic oxide to the system in the step (B) is noticeably effective for preventing the toner particles from fusing in the apparatus where the particles are being produced. It is said that toner particles will fuse because their kinetic energy is converted into thermal energy. It is believed that the inorganic oxide added in the step (B) could act to reduce the contact between the toner matrix and the wall of the apparatus where the toner is being produced (that is, it could prevent the toner from colliding against the wall of the apparatus). Even if some toner particles fuse in the apparatus, the inorganic oxide will act to scrape the fused particles from the wall of the apparatus. As a result, the fused particles could no more grow. For these reasons, the inorganic oxide added in the step (B) will effectively prevent the toner particles from fusing in the apparatus.

Adding the inorganic oxide in the step (B) may be effected in any stage of the step (B). For example, the crushed or ground particles are once taken out of the grinding unit, and metered, and thereafter a predetermined amount of the inorganic oxide may be added thereto. However, this method requires one additional step. Regarding the site at which the inorganic oxide is added to the system in the step (B), for example, the additive, inorganic oxide may be added to the system via the feed port of a crusher, via the feed port of a grinder, directly into the grinder, via the pipe around the take-out port of the grinder, or via the feed port of a classifier (around a metering feeder). The site for the additive addition is not limited to only one, but the additive may be added to the system in plural sites.

Where the inorganic oxide is added to the system via a metering feeder or via a pipe line, an opening for the additive may be formed through the feeder or the pipe so that a predetermined amount of the additive, inorganic oxide could be added to the system via the opening. Where it is added directly into a grinder, an injection nozzle may be used for its addition. A classifier for separating coarse particles may be sealed with air streams around the rotor therein so as to prevent fine powder from entering the classifier. The additive may be added to the system via the sealing air streams.

As the case may be, the additive may be added via the port for secondary air to be introduced into a grinder and a classifier.

Preferably, the inorganic oxide is added to the system just before the classification process where the toner particles will much fuse, as it could prevent more effectively the fusion of the toner particles. Even when the additive, inorganic oxide is added in the former stage of the grinding and classification process, for example, when it is added through the feed port of a grinder, its effect for preventing the toner fusion lasts to the latter stage throughout the classification process. However, the case will be not so effective, as compared with the preferred case where the additive is added just before the classification process.

The amount of the second inorganic oxide to be added to the system in the step (B) is between 0.05 and 5.0 parts by weight, more preferably between 0.1 and 1.5 parts by weight, relative to 100 parts by weight of the kneaded mixture having been prepared in the previous kneading step (A) and flowing in the process. If its amount is smaller than 0.05 parts by weight, the additive will poorly exhibit its effect for preventing the toner particles from fusing in the apparatus. On the other hand, even if the amount is larger than 5.0 parts by weight, the effect of the additive will be saturated and could no more be augmented. Adding such a larger amount of the additive, inorganic oxide may be effected for any other purpose but not for the purpose of reducing the toner fusion. For example, it may be effected for the purpose of increasing the amount of the external additives to that naturally needed by the toner.

(C) Step of Adding External Additives:

In the step (C), the third inorganic oxide is added to the system for the purpose of making the toner grains fluid and making them have a charging capability.

In the step (C), for example, the inorganic oxide may be added to the system in a process of mixing other external additives with the toner particles for the purpose of making the toner particles fluid and making them having a charging capability and a cleaning capability. Where an air sieving unit is used in processing the toner particles, the inorganic oxide may be fed into the unit via the air pipe running to the back-washing air nozzle inserted in the unit. Back-washing air is for preventing the meshes of the sieve from being clogged.

Subtracting the amount of the inorganic oxide added in the step (B) from the amount thereof planned as the external additive for the toner gives the amount of the inorganic oxide to be added in the step (C). Specifically, adding the inorganic oxide in the step (C) is first for controlling the amount of the external additive, inorganic oxide to be in the toner, and secondly for increasing the adhesive strength of the external additive to the intended degree. In the step (C), the sort of the inorganic oxide to be added shall be the same as that thereof added in the step (A) and the step (B). Along with it, optionally, a different sort of an inorganic oxide and the like may also be added in the step (C). Such optional additives are for controlling the antistatic capability, the fluidity, the cleaning capability and the transferability of the toner. The different sort of an inorganic oxide as referred to herein is meant to indicate an inorganic compound not containing the same metal element for its core. Adding such a different sort of an inorganic oxide is not limited only in the step (C), but may be effected in any of the step (A) and the step (B).

The inorganic oxide to be added in the step (A), the step (B) and the step (C) may be any one that contains the same metal element at least for its core. Preferably, however, the same inorganic oxide is added to the system in every step. The inorganic oxide to be added in each step is not limited to only one, but two or more inorganic oxides may be added therein.

Inorganic Oxide to be Added to Each Step:

The inorganic oxide shall have at least a core, in which the core may be processed with any desired surface-treating agent to form a coat layer that covers the core. The inorganic oxide for use herein, which contains the same metal element at least for its core, is meant to indicate that the coat layer to cover the core may differ in different inorganic oxides for use herein so far as the oxides all contain the same metal element at least for its core.

The core includes, for example, titania, titanium compounds, silica, alumina, tin oxide, etc. Especially for color toners, preferred are colorless or pale inorganic oxides not having any negative influence on the color of colorants.

Processing the inorganic oxide with a surface-treating agent is for making it chargeable and for making it have environmental compatibility and miscibility with other toner components. For example, for the surface-treating agent, usable are silane compounds such as silane coupling agents, etc. The silane compounds may be of any type, including, for example, chlorosilanes, alkoxysilanes, silazanes, and special silylating agents.

Examples of the silane compounds include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltriethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, mercpatopropyltrimethoxysilane, γ-chloropropyltrimethoxysilane, etc. However, the agent for use in the invention is not limited to these compounds.

The mean primary grain size of the inorganic oxide preferably is between 5 and 50 nm, more preferably between 10 and 40 nm. If its grain size is larger than 50 nm, the inorganic oxide will poorly exhibit its effect for reducing the toner fusion in production equipment. If so, in addition, when the amount of the inorganic oxide added increases, especially when the amount thereof is 2.0 parts by weight or more relative to 100 parts by weight of the toner being produced, the transparency of the images formed will be low.

On the other hand, if its grain size is smaller than 5 nm, the inorganic oxide will also poorly exhibit its effect for reducing the toner fusion in production equipment.

As the inorganic oxide, especially preferred is a titanium compound as prepared by processing a part or all of $TiO(OH)_2$ produced in a wet process, with a silane compound. The titanium compound improves both the dispersibility of colorants and the charging characteristics of toner. For the latter, for example, the charge spectrum of toner could be narrowed, and the miscibility of toner with other ingredients could be improved.

Though not clear, the titanium compound will owe its capabilities to its physical morphology. The titanium compound is in the form of flat columnar pellets having a diameter of from 30 to 70 μm and a height of from 5 to 20 μm, and its surface area is large relative to the unit weight. When dispersed in toner, it is believed that the compound will firmly adhere to colorants thereby preventing strong aggregation of colorants in toner. Also owing to its physical morphology, it is believed that the titanium compound could improve the charging characteristics of toner, as it could firmly adhere to the toner matrix. Specifically, the adhesive strength of the compound added to toner in the step (C) as the external additive could be controlled nearer to that of the inorganic oxide added in the step (A) (the additive, inorganic oxide is exposed outside the surface of the toner) and even to that of the inorganic oxide added in the step (B) (especially when the additive is added before the grinding process). As a result, the adhesive strength distribution in the external additive could be narrowed, thereby resulting in that the charge spectrum of the toner produced and even the miscibility of the toner with other ingredients could be improved.

Any of the silane compounds mentioned hereinabove is usable as the surface-treating agent for the core, $TiO(OH)_2$. The amount of the agent to be used for the surface treatment of the core varies, depending on the mean primary grain size of the core grains of $TiO(OH)_2$. In general, however, the amount of the silane compound to be used preferably falls between 5 and 80 parts by weight, more preferably between 10 and 50 parts by weight, relative to 100 parts of the core, $TiO(OH)_2$.

If its amount is smaller than 5 parts by weight, the silane compound could not exhibit its function; but if larger than 80 parts by weight, the excess silane compound will make toner oily and will worsen the fluidity of toner. However, the treatment with the silane compound will be for increasing the charging capability, the environmental compatibility, and the fluidity of toner, and for reducing the interaction between toner and photosensitive materials. Therefore, the amount of the treating agent to be used shall be determined, depending on the type of the toner to be produced, the developer carrier to be used, and the grain size of the core $TiO(OH)_2$ to be processed.

In the invention, the inorganic oxide may be added to the system in the step (B), directly into a grinder or via the feed port of the grinder or even via the pipe line around the take-out port of the grinder, whereby the toner fusion in the grinder and the pipe line around the take-out port of the grinder could be prevented. In addition, the inorganic oxide thus added could increase the classification efficiency in the latter stage of the grinding and classification process, and could improve toner characteristics, especially the charging capability and the charge retentiveness of toner. It is believed that the reason will be because the inorganic oxide added could improve the powdery fluidity and also the dispersibility of toner particles, thereby facilitating the particle classification. The inorganic oxide could improve the charge retentiveness of toner for the following reason. While powdery toner is processed in a grinder and before and after it, it moves in the units at a high speed. During the process, therefore, the inorganic oxide adheres strongly to the powdery toner particles. On the other hand, however, when a developer including the toner particles is used in duplicators and the like, it is deteriorated essentially owing to the inorganic oxide impaction. According to the technique of the invention, it is believed that the inorganic oxide impaction in the developer could be reduced.

Where the inorganic oxide is added to toner particles via the feed port of a classifier in the classification process, it is especially effective for reducing the toner fusion in the classifier. The effect is remarkable in an inertial classifier. In particular, the inorganic oxide much reduces the toner fusion in the ejector and around the edges that determine the classification point in an inertial classifier. The effect of the inorganic oxide is also remarkable in a centrifugal classifier. In particular, the toner fusion-preventing effect of the inorganic oxide added to the system in the classification process is more remarkable around the toner-injecting port of the centrifugal classifier used, than that of the inorganic oxide added thereto in any other process.

Toner-Forming Material:

The toner-forming material to be kneaded in the step (A) is described.

The toner-forming material contains at least a binder resin and a colorant, and optionally contains any other ingredients. The inorganic oxide to be added to toner in the steps (A) to (C) may be in the toner-forming material. In this case, the inorganic oxide to be added in the step (A) is an internal additive.

Binder Resin:

The binder resin for use herein may be any and every thermoplastic resin generally used in usual toner.

Concretely, it includes homopolymers and copolymers of styrenes such as styrene, chlorostyrene, etc.; mono-olefins such as ethylene, propylene, butylene, isoprene, etc.; vinyl esters such as vinyl acetate, vinyl propionate, vinyl benzoate, vinyl butyrate, etc.; aliphatic α-methylene-monocarboxylates such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc.

Specific examples of the binder resin are polystyrenes, styrene-alkyl acrylate copolymers, styrene-alkyl methacrylate copolymers, styrene-acrylonitrile copolymers, styrene-butadiene copolymers, styrene-maleic anhydride copolymers, polyethylenes, polypropylenes, etc. Also usable as the binder resin are polyesters, polyurethanes, epoxy resins, silicone resins, polyamides, modified rosins, paraffin waxes, etc.

Of the binder resins noted above, preferred are those of which the structure and the molecular weight are so controlled that they could have a melting point falling between 80 and 150° C. In particular, styrene-acrylic resins and polyester resins are more preferred and are used positively herein.

In the invention, especially preferably used are polyester resins having a number-average molecular weight, Mn of 2500 to 5500, a weight-average molecular weight, Mw of 7000 to 30000, a softening point of 90 to 120° C. and a glass transition point of 60 to 75° C., but not containing a chloroform-insoluble fraction, optionally combined with styrene-indene copolymers that serve as a grinding promoter. This is because the toner that contains the binder resin of that type could have a sharp (narrow) particle size distribution after ground, and could realize high-quality images. Another advantage of the binder resin of that type is that it has no negative influence on the toner characteristics including the fixing capability and the charging capability of toner.

The polyester resins may be produced from a polyalcohol component and a polycarboxylic acid component. The polyalcohol component includes, for example, dialcohols such as ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexane-dimethanol, dipropylene glycol, polyethylene glycol, polypropylene glycol, bisphenol A, hydrogenated bisphenol A, etc.; tri- or higher poly-alcohols such as glycerin, sorbitol, 1,4-sorbitan, trimethylolpropane, etc.

The di-carboxylic acid component to be condensed with the polyalcohol component includes, for example, maleic acid, maleic anhydride, fumaric acid, phthalic acid, terephthalic acid, isophthalic acid, malonic acid, succinic acid, glutaric acid, dodecenylsuccinic acid, n-octylsuccinic acid, and their lower alkyl esters.

Preferably, the binder resin for use in the invention includes, as the constituent components, a di-alcohol component of polyoxyethylene(2,2)-bis(4-hydroxyphenyl) propane or polyoxypropylene(2,2)-bis(4-hydroxyphenyl) propane, or a tri- or higher poly-alcohol component, as combined with a di-carboxylic acid component.

The melting point of the resin binder indicates the temperature at which the resin has a melt viscosity of $1\times10^4$ Pa.s, on the temperature-apparent viscosity curve of the resin. The melt viscosity of the resin is measured with a flow tester, CFT-500F Model (from Shimadzu Seisakusho). From the data, obtained is the temperature-apparent viscosity curve. The condition for the measurement is as follows. Heating rate, 3.0° C./min. Start temperature, 80.0° C. Final temperature, 150.0° C. Interval, 3.0 seconds. Pre-heating time 300.0 seconds. Cylinder pressure, 10.0 kgf/cm$^2$. Die orifice diameter, 1.0 mm. Die length, 1.0 mm.

Colorant:

Typically, the colorant to be in the toner of the invention includes carbon black, nigrosine dyes, aniline blue, chalcoyl blue, chrome yellow, ultramarine blue, DuPont oil red, quinoline yellow, methylene blue chloride, phthalocyanine blue, malachite green oxalate, lamp black, rose bengale, C.I. Pigment Red 48:1, C.I. Pigment Red 57:1, C.I. Pigment Red 122, C.I. Pigment Yellow 12, C.I. Pigment Yellow 97, C.I. Pigment Blue 15:1, C.I. Pigment Blue 15:3, etc.

Also employable herein are a flashed pigment product to be prepared by kneading an aqueous pigment paste and a binder resin under normal pressure at a temperature not lower than the softening point of the resin followed by flashing the resulting mixture; and high-concentration pigment pellets to be prepared by heating and melting a dry pigment for the colorant and a binder resin followed by mixing them with high shearing force applied thereto, for example, by mixing them in a two-roll or three-roll heating unit or the like. From the viewpoint of the colorant dispersibility, the latter are preferred.

The amount of the colorant to be in the toner of the invention preferably falls between 0.5 and 15 parts by weight relative to 100 parts by weight of the binder resin, more preferably between 1 and 10 parts by weight. If the amount is smaller than 0.5 parts by weight, the coloring power of the toner will be low, and the toner could not sufficiently exhibit its effect. If, on the other hand, the amount is larger that 15 parts by weight, the transparency of the toner images formed will be low.

Other Ingredients:

Magnetic Substance:

For producing magnetic toner, a part or all of the colorant to be may be replaced with a magnetic substance. The amount of the magnetic substance may fall between 50 and 200 parts by weight relative to 100 parts by weight of the binder resin. The magnetic substance may be any and every one known and generally used in the art. For example, it includes metals such as iron, cobalt, nickel, etc.; their alloys; metal oxides such as $Fe_3O_4$, $\gamma$-$Fe_2O_3$, cobalt-doped iron oxide, etc.; ferrites such as MnZn ferrite, NiZn ferrite, etc. The magnetic substances may have a mean grain size generally falling between 0.05 and 0.5 $\mu$m. For improving their charging characteristics and dispersibility, the magnetic substances for use in the invention may be processed with a surface-treating agent such as a silane coupling agent, a titanate coupling agent, etc. However, non-processed magnetic powder is preferred in the invention, as being more effective.

Lubricant:

As another ingredient, the toner-forming material may contain a lubricant, which is for improving the offset resistance of toner.

As the lubricant, preferred are paraffins and polyolefins having at least 8 carbon atoms. For example, usable are paraffin wax, paraffin latex, microcrystalline wax, low-molecular polypropylene, low-molecular polyethylene and the like, either singly or as combined. The softening point of the lubricant for use herein preferably falls between 110 and 150° C. Where two or more lubricants are used, as combined, it is desirable that the processing temperature is controlled and set in accordance with the lubricant having a lowermost softening point of all.

The amount of the lubricant to be added preferably falls between 1 and 15 parts by weight, more preferably between 3 and 10 parts by weight, relative to 100 parts by weight of the binder resin. If its amount is smaller than 1 part by weight, the lubricant could not exhibit its effect; but if larger than 15 parts by weight, too much lubricant will noticeably worsen the fluidity of toner and, in addition, it will greatly broaden the charge spectrum of toner.

The softening point of lubricants may be measured in accordance with the softening point test method (ring and ball method) in JIS K-2207.

Antistatic Agent:

As still another ingredient, the toner-forming material may contain an antistatic agent. The antistatic agent includes, for example, fluorine-containing surfactants; metal-containing dyes such as metal salicylate complexes, metal-containing azo compounds; polymer acids such as copolymers containing maleic acid as the monomer component; quaternary ammonium salts; azine dyes such as nigrosines, etc.

External Additives to be Added in the External Additive-Mixing Step:

The additive, inorganic oxide added in the previous steps (A) and (B) is again added to the system in the external additive-mixing step (C) as an external additive. Apart from it, other external additives may be added thereto in the external additive-mixing step. They include, for example, a fluidizing agent and its promoter, such as fine polymer grains (e.g., polycarbonates, polymethyl methacrylates, silicone resins, etc.). These external additives will adhere onto the surfaces of the toner grains.

Toner for Electrophotography:

The toner for electrophotography of the invention contains toner particles that contain at least a colorant and a binder resin. In this, the toner particles contain, both in the inside and in the surface, an inorganic oxide containing the same metal element at least for its core, and the amount of coarse particles having a particle size of not smaller than 20 μm is at most 100 ppm.

The toner for electrophotography of the invention is favorably produced according to the above-mentioned toner production method of the invention.

The toner for electrophotography of the invention contains at least a colorant, a binder resin and an inorganic oxide, and optionally contains any other ingredients.

The colorant and the binder resin may be the same as those to be in the toner-forming material that is processed in the kneading step in the toner production method of the invention. The other ingredients constituting the toner may also be the same as those to be in the toner-forming material and those to be added to the toner grains in the external additive-mixing step in the toner production method. In addition, as still other additives to the toner, also usable are copolymer resins of styrene monomers and indene monomers, as well as copolymer petroleum resins of aliphatic hydrocarbons and aromatic hydrocarbons having at least 9 carbon atoms. The inorganic oxide to be in the toner may be the same as that used in each step in the toner production method of the invention.

The toner of the invention is favorably produced according to the toner production method of the invention. In this, therefore, the toner particles contain, both in the inside and in the surface, an inorganic oxide containing the same metal element at least for its core. Specifically, the toner particles contain, in the inside, the inorganic oxide added thereto as the internal additive in the kneading step, and contain, in the surface, the inorganic oxide added thereto as the external additive in the grinding and classifying step and in the external additive-mixing step.

The amount of the inner inorganic oxide to be in the inside of the toner particles of the invention preferably falls between 0.05 and 5.0 parts by weight, more preferably between 0.1 and 2.0 parts by weight, relative to 100 parts by weight of the toner-forming material (colorant and binder resin) not including the inorganic oxide. If the amount is larger than 5.0 parts by weight, the colorant dispersibility could be improved to a higher degree but the transparency of full-color images formed with the toner will be lowered. On the other hand, if the amount is smaller than 0.05 parts by weight, the additive could not exhibit its capability to improve the colorant dispersibility.

In the toner of the invention, the amount of coarse particles having a grain size of not smaller than 20 μm is at most 100 ppm. Reducing the amount of such coarse particles to the defined range can be favorably attained in the toner production method of the invention. Specifically, in the method, the inorganic oxide is added to the system in all of the kneading step, the grinding and classifying step and the external additive-mixing step, and therefore the amount of coarse particles to be in the toner produced can be reduced. Accordingly, in the method, fine toner particles having a reduced particle size can be produced efficiently. In the method, it is desirable that the toner particles produced are sieved through a 45 μm-mesh sieve to obtain the toner of the invention. However, the toner of the invention does not always require sieving through the sieve.

In the toner of the invention, the amount of coarse particles having a grain size of not smaller than 20 μm is at most 100 ppm, but preferably at most 50 ppm. The toner in which the amount of coarse particles having a particle size of not smaller than 20 μm is not larger than 100 ppm is preferred, as it is free from transfer failure that may cause image defects such as white spots and toner grids.

Preferably, the volume-average particle size of the toner of the invention falls between 4 and 12 μm, more preferably between 6 and 9 μm.

The amount of coarse particles having a particle size of not smaller than 20 μm in the toner of the invention may be measured as follows: First, the toner is sieved through a 45 μm-mesh sieve such as that mentioned above. 1000 g of the thus-sieved toner is further sieved through a standard 20 μm-mesh sieve according to a suction-sieving method. The weight of the coarse particles remained on the standard sieve is measured on a precision balance, and it is represented in terms of ppm.

The toner for electrophotography of the invention may be used for any of one-component development or two-component development, but is preferably used for two-component development for which the toner is combined with a resin-coated carrier. Using a resin-coated carrier as the carrier for the toner of the invention in which the toner particles have a reduced particle size is preferred, as it improves the rising profile for static electrification of the small-sized toner particles, prevents the charge spectrum of the toner from being broadened, and prevents the reduction in the charging degree of the toner, thereby preventing background staining and uneven image density in duplications.

The carrier for the toner of the invention is not specifically define, may be any known one. For example, it includes iron powder carriers, ferrite carriers, surface-coated ferrite carriers, etc. These may be coated with a powdery substance, and the powdery substance for these may be subjected to any desired surface treatment.

Method of Image Formation:

The toner for electrophotography of the invention, having the constitution as above, is favorable to any known image formation. For example, it is favorably used in a method of image formation which includes a step of developing an electrostatic latent image formed on an electrostatic latent image carrier with a toner to form a toner image, a step of transferring the toner image onto an image-receiving object to form a transferred image thereon, and a step of fixing the transferred image on the object.

In the method of image formation with the toner of the invention, the charging capability of the toner used is deteriorated little and good images with no fog are formed.

EXAMPLES

The invention is described more concretely with reference to the following Examples, which, however, are not intended to restrict the scope of the invention. Unless otherwise specifically indicated, "parts" in the following description are all "by weight".

Example 1

| | |
|---|---|
| Binder resin: | |
| Polyester resin (terephthalic acid/bisphenol A-ethylene oxide adduct/cyclohexane-dimethanol = 50/25/25; Mw = 16000; Mn = 4400; Tg = 67° C.; melting point, Tm = 110° C.); | 94.5 parts |
| Colorant: | |
| C.I. Pigment Red 122 | 5.0 parts; |
| Inorganic oxide A: | 0.5 parts |

-continued

| |
|---|
| (titanium compound as prepared by processing 100 parts by metatitanic acid with 50 parts of isobutyltrimethoxysilane followed by baking it; having a mean primary grain size of 30 nm). |

A toner-forming material containing the above ingredients is mixed in the material-mixing stage (1) in the step (A) of the toner-producing process illustrated in FIG. 2. The resulting mixture is further mixed and stirred in a 75-liter Henschel mixer (from Mitsui-Miike), then fed into a screw extruder via a metering feeder, and kneaded therein.

The kneaded mixture is rolled and cooled on a water-cooling conveyer, roughly crushed in a pin crusher, ground in a hammer mill into grains having a mean particle size of 300 μm, further ground in a fluidized-bed grinder, AFG400 (from Alpine), and thereafter classified in an inertial classifier, EJ30 to prepare toner particles having a volume-average particle size of about 7 μm. In this process, a fresh additive of the inorganic oxide A is continuously added to the mixture being processed, in a ratio of the mixture to the inorganic oxide A of 100/0.5 by weight. In the step (B), the fresh additive is added through the feed port of the grinder (3).

To 100 parts of the toner particles, added are external additives, 0.7 parts of the inorganic oxide A and 0.5 parts of an inorganic oxide B (hexamethyldisilazane-processed silica having a mean grain size of 40 nm), at the site (8) in the step (C). These are mixed in a 75-liter Henschel mixer for 10 minutes, and then sieved through a 45 μm-mesh air sieve, Hivolter 300 (from Shin-Tokyo Kikai) to obtain a toner 1.

The grain size distribution of the grains is measured with Coulter Electronics' Coulter Multisizer II.

Example 2

A toner 2 is produced in the same manner as in Example 1, except for the step (B) and the step (C). Precisely, in the step (B) in this, the additive, inorganic oxide A is added to the system directly into the grinder (4) and via the feed port of the classifier (6), but not via the feed port of the grinder (3), in a ratio of the mixture being processed to the inorganic oxide A of 100/0.3 and 100/0.4, respectively, by weight; and in the step (C), 0.5 parts of the additive, inorganic oxide A only is added to the system but the other additive, inorganic oxide B is not.

Example 3

A toner 3 is produced in the same manner as in Example 1, except for the toner-forming material and for the steps (B) and (C). Precisely, in this, the toner-forming material contains a polyester resin (terephthalic acid/bisphenol A-ethylene oxide adduct/cyclohexane-dimethanol=50/25/25; Mw=21000; Mn=4900; Tg=69° C.; melting point, Tm=120° C.) as the binder resin, a phthalocyanine pigment, Pigment 15:3 as the colorant, and an inorganic oxide C (silicone oil-processed silica having a mean primary grain size of 20 nm) but not the inorganic oxide A; the inorganic oxide C but not the inorganic oxide A is added to the system in the step (B) directly into the grinder (4) but not via the feed port of the grinder (3); and 0.5 parts of the inorganic oxide C but not the inorganic oxide A is added in the system (C) along the PMMA resin (having a mean grain size of 300 nm) in place of the inorganic oxide B. In the step (B) in this, the inorganic oxide A is added to the system directly into the grinder (4) through an injection nozzle inserted into the grinder, for which the air pressure is 1.0 kg/cm$^2$.

Example 4

A toner 4 is produced in the same manner as in Example 3, except for the step (A) and the step (B). Precisely, in this, the inorganic oxide C added in the step (A) contains a mixture of classified fine powder, classified coarse powder and ground fine powder of toner; and in the step (B), the inorganic oxide C is added to the system via the feed port of the classifier (6) but not directly into the grinder (4).

The blend ratio of the mixture of classified fine powder, classified coarse powder and ground fine powder of toner to the inorganic oxide C in the toner-forming material processed herein is 98.5 parts/1.5 parts. For its composition, the toner-forming material contains 63.4 parts of the binder resin, 3.3 parts of the colorant, and 33.3 parts of the mixture as prepared by blending the mixture of classified fine powder, classified coarse powder and ground fine powder of toner with the inorganic oxide C (in which the amount of the mixture of classified fine powder, classified coarse powder and ground fine powder of toner is 32.8 parts, and the amount of the inorganic oxide C is 0.5 parts).

Comparative Example 1

A toner 5 is produced in the same manner as in Example 1, except for the step (A). Precisely, in this, the inorganic oxide A is not added to the system in the material mixing stage (1) in the step (A).

Comparative Example 2

A toner 6 is produced in the same manner as in Example 1, except for the step (A). Precisely, in this, the inorganic oxide C but not the inorganic oxide A is added to the system in the material mixing stage (1) in the step (A).

Comparative Example 3

A toner 7 is produced in the same manner as in Example 2, except for the step (B) and the step (C). Precisely, in this, the inorganic oxide A is not added to the system in step (B), and 1.2 parts of the inorganic oxide A is added thereto in the step (C).

Comparative Example 4

A toner 8 is produced in the same manner as in Example 3, except for the steps (A) to (C). Precisely, in this, decyltrimethylethoxysilane-processed titanium oxide having a mean grain size of 20 nm but not the inorganic oxide C is added to the system in the step (A) and also in the step (B), and 1.2 parts of the inorganic oxide C is added thereto in the step (C).

The toners 1 to 8 produced are evaluated as follows. The results are given in Table 1.

Mean Diameter of Dispersed Colorant Grains:

The slab as prepared by kneading, rolling and cooling the toner-forming material is cut with a microtome or the like into pieces having a thickness of about 0.15 μm. A TEM image (×4500) of each piece taken with a transmission electronic microscope is analyzed with an image analyzer to measure the diameter (circle-corresponding diameter) of each colorant grain see in the field of view of 60 μm×45 μm.

The samples in which the mean diameter of dispersed colorant grains is smaller than 0.1 μm are in rank A; those with it being from 0.1 μm to smaller than 0.2 μm are in rank B; those with it being from 0.2 μm to smaller than 0.5 μm are in rank C; and those with it being 0.5 μm or larger are in rank D.

Degree of Toner Fusion in Apparatus:

In the classifier used, toner grains fuse most on the EJ30 edge (edge F). The amount of the fused toner grains on the edge F is measured for each sample. Precisely, 100 kg of ground toner grains are fed into the classifier, and the fused toner deposit on the edge F is scraped away from the tip of the edge to 5 mm below it. The weight of the scraped deposit is measured on a precision balance.

Where the amount of the deposit is smaller than 20 mg per 100 kg of the ground toner grains fed into the classifier, the samples are in rank A; where it is from 20 mg to less than 100 mg, the samples are in rank B; where it is from 100 mg to less than 500 mg, the samples are in rank C; and where it is 500 mg or more, the samples are in rank D.

Yield in Classification for Grains of the Same Size:

The yield in classification for grains of the same grain size is represented by a formula: (weight of classified grains)/(weight of ground grains fed into the classifier). Where the additive, inorganic oxide is added to the grains being classified, the weight of the additive is added to the weight of the ground grains fed into the classifier to be the denominator in the formula.

The samples having the classification yield of 85% or more are in rank A; those having the classification yield of from 80% to less than 85% are in rank B; those having the classification yield of from 70% to less than 80% are in rank C; and those having the classification yield of less than 70% are in rank D.

Coarse Grains (20 μm or more in size) in Toner:

1000 g of the toner produced in the process as above is sieved through a 45 μm-mesh air sieve, Hivolter 300 (from Shin-Tokyo Kikai), and then further sieved through a standard 20 μm-mesh sieve according to a suction-sieving method. The weight of the coarse grains remained on the standard sieve is measured on a precision balance. This indicates the amount of the coarse grains (remained on the 20 μm-mesh sieve) in 1000 g of the toner, and it is represented in terms of ppm.

The amount of the coarse grains remaining in the toner 1 is 34 ppm; that in the toner 2 is 16 ppm; that in the toner 3 is 58 ppm; that in the toner 4 is 19 ppm; that in the toner 5 is 130 ppm; that in the toner 6 is 71 ppm; that in the toner 7 is 602 ppm; and that in the toner 8 is 27 ppm.

The samples in which the amount of the coarse grains remained is smaller than 20 ppm in 1000 g are in rank A; those with it being from 20 ppm to less than 100 ppm are in rank B; those with it being from 100 ppm to less than 500 ppm are in rank C; and those with it being 500 ppm or more are in rank D.

On the other hand, ferrite core grains having a mean grain size of 50 μm are coated with vinylidene chloride (its amount corresponds to 0.05% by weight) and methyl methacrylate/trifluoroethylene (80/20) copolymer resin (its amount corresponds to 1.25% by weight) in a kneader to prepare a carrier. The carrier is blended with any of the toners 1 to 8 in a ratio of 100 parts/6 parts, in a 2-liter V-blender, to produce developers 1 to 8.

Charging Capability (charge spectrum) of Toner:

The charging capability of the developers 1 to 8 is measured with a charge spectrometer (from Xerox), and the ratio of the width of the spectrum, B, to the value at the center of the spectrum, A, is obtained (B/A). The samples having the ratio B/A of smaller than 0.4 are in the rank A; those having the ratio of from 0.4 to less than 0.5 are in rank B; those having the ratio of from 0.5 to less than 1.0 are in rank C; and those having the ratio of 1.0 or more are in rank D.

Fog in Images, and Charge Retentiveness of Toner:

The developers 1 to 8 are tested for their printing durability in duplication with a duplicator, A-Color 635 (from Fuji Xerox), at 35° C. and 85% RH. In the test, 100,000 copies are duplicated with each developer. After the test to give 100,000 duplications, the image quality (with respect to fog in background) is checked on the duplicated copies and on the photoreceptor, and the charge retentiveness of the tested developers is measured.

The samples with which the image formed has no fog in the background both on the duplicated copies and on the photoreceptor are in rank A; those with which the image formed is fogged in the background on the photoreceptor but not on the duplicated copies are in rank B; and those with which the image formed is fogged in the background on the duplicated copies are in rank C.

The charge retentiveness of developers is represented by the ratio of the charge of the tested developer to the initial charge (1, one) of the fresh developer. The samples having the charge retentiveness of 0.7 or more are in rank A; those having the charge retentiveness of from 0.3 to less than 0.7 are in rank B; and those having the charge retentiveness of less than 0.3 are in rank C.

TABLE 1

| | Diameter of Dispersed Colorant Grains | Classification: Grain Fusion | Classification: Yield | Amount of Coarse Grains Remained in Sieved Toner | Charge Spectrum | Characteristics in Duplicator: Fog in Image | Characteristics in Duplicator: Charge Retentiveness | Total Evaluation |
|---|---|---|---|---|---|---|---|---|
| Example 1 | B | B | A | B | A | B | B | A |
| Example 2 | B | A | B | A | B | B | B | B |
| Example 3 | B | B | A | B | B | B | B | B |
| Example 4 | A | A | B | A | B | B | B | A |
| Comp. Ex. 1 | C | C | B | C | C | C | C | D |
| Comp. Ex. 2 | B | B | B | B | D | D | D | D |

TABLE 1-continued

| | Diameter of Dispersed Colorant Grains | Classification Grain Fusion | Classification Yield | Amount of Coarse Grains Remained in Sieved Toner | Charge Spectrum | Characteristics in Duplicator Fog in Image | Charge Retentiveness | Total Evaluation |
|---|---|---|---|---|---|---|---|---|
| Comp. Ex. 3 | B | D | D | D | B | B | B | D |
| Comp. Ex. 4 | B | B | B | B | D | D | D | D |

From the results in Table 1, it is seen that the toners 1 to 4 of Examples 1 to 4 of the invention are excellent in that they fuse little in the apparatus, that the colorant grains well disperse therein, and that the amount of coarse grains therein having a grain size of 20 μm or more is small. In addition, it is also seen that the toners 1 to 4 of Examples 1 to 4 of the invention give good images with no fog in the background and their charge is lowered little while used for image formation.

However, the toners 5 to 8 of Comparative Examples 1 to 4 are all inferior to the toner of the invention with respect to any of the toner characteristics tested.

As described in detail hereinabove with reference to its preferred embodiment, the invention provides an excellent toner for electrophotography and a method for producing it. Specifically, the toner of the invention fuses little in the apparatus where it is produced, and its productivity is high. In addition, the toner has good characteristics including charging characteristics and coloring characteristics, and the amount of coarse grains in the toner is small. The invention further provides a method of image formation with the toner. In the method, the toner gives good image with no fog, and the charge retentiveness of the toner used for image formation is high.

While the invention has been described in detail and with reference to specific embodiments thereof, it will be apparent to one skilled in the art that various changes and modifications can be made therein without departing from the spirit and scope thereof.

What is claimed is:

1. A toner for electrophotography comprising a toner particles containing a colorant and a binder resin, wherein the toner particles containing an inner inorganic oxide therein and an outer inorganic oxide thereon, the inner inorganic oxide includes the same metal element with the metal element in the outer inorganic oxide, and the amount of toner particles having a size of not smaller than 20 μm is not more than 100 ppm.

2. The toner for electrophotography according to claim 1, wherein the metal element is selected from the group consisting of silicon, titanium and aluminium.

3. The toner for electrophotography according to claim 1, wherein the inorganic oxide having a mean primary grain size of about 5 to 50 nm.

4. The toner for electrophotography according to claim 1, wherein the binder resin having a melting point of about 80 to 150° C.

5. The toner for electrophotography according to claim 4, wherein the binder resin is selected from the group consisting of polyesters and styrene-acrylic resins.

6. The toner for electrophotography according to claim 1, wherein the amount of particles having a size of not smaller than 20 μm is not more than 50 ppm.

7. The toner for electrophotography according to claim 1, wherein the toner particles having a volume-average particle size of about 4 to 9 μm.

8. The toner for electrophotography according to claim 1, further containing a wax.

9. The toner for electrophotography according to claim 1, wherein the binder resin having a number-average molecular weight of about 2500 to 5500, a weight-average molecular weight of about 7000 to 30000, and softening point of about 90 to 120° C.

10. The toner for electrophotography according to claim 1, wherein both the inner and outer inorganic oxide are in a form of particles.

11. An image forming method comprising a step of developing an electrostatic latent image which forming on an electrostatic latent image carrier with a toner to form a toner image, a step of transferring the toner image onto an image-receiving medium to form a transferred image thereon, and a step of fixing the transferred image on the medium, wherein the toner for electrophotography as in claim 1 is used.

12. A method for producing a toner for electrophotography comprising a step of kneading a toner-forming material to prepare a kneaded mixture, a step of grinding and classifying the kneaded mixture to prepare toner particles, and a step of mixing an external additive in the toner particles, wherein inorganic oxide having same metal element with the metal element in the external additives are added in both the kneading step and the grinding and classifying step.

13. The method for producing a toner for electrophotography according to claim 12, wherein organic oxide is added in the grinding and classifying step just before the ground grains are classified in a classifier.

14. The method for producing a toner for electrophotography according to claim 12, wherein the inorganic oxide is added in the grinding and classifying step directly into a grinder through an injection unit inserted thereinto or via a feed port of the grinder.

15. The method for producing a toner for electrophotography according to claim 12, wherein the amount of the inorganic oxide to be added in the kneading step is from 0.05 to 5.0 parts by weight relative to 100 parts by weight of the toner-forming material.

16. The method for producing a toner for electrophotography according to claim 12, wherein the amount of the inorganic oxide to be added in the grinding and classifying step is from 0.05 to 5.0 parts by weight relative to 100 parts by weight of the kneaded mixture.

17. The method for producing a toner for electrophotography according to claim 12, wherein the amount of the inorganic oxide to be added in the external additive mixing step is from 0.01 to 5.0 parts by weight relative to 100 parts by weight of the kneaded mixture.

* * * * *